US007477032B2

(12) United States Patent
Choi et al.

(10) Patent No.: US 7,477,032 B2
(45) Date of Patent: Jan. 13, 2009

(54) COMPRESSOR AND A DRIVING METHOD THEREOF

(75) Inventors: Hyen-young Choi, Suwon-si (KR); Kwang-woon Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/520,736

(22) Filed: Sep. 14, 2006

(65) Prior Publication Data

US 2007/0085501 A1 Apr. 19, 2007

(30) Foreign Application Priority Data

Oct. 14, 2005 (KR) ..... 10-2005-0097081

(51) Int. Cl.
*H02P 6/20* (2006.01)

(52) U.S. Cl. ..... 318/431; 318/400.11

(58) Field of Classification Search ..... 318/138, 318/254, 268–272, 276–278, 430–434, 439, 318/720–724, 700, 400.01, 400.11; 417/44.1
See application file for complete search history.

(56) References Cited

U.S. PATENT DOCUMENTS 4,736,143 A * 4/1988 Nakamura et al. ..... 318/432
4,888,533 A * 12/1989 Gotoh et al. ..... 318/524
5,227,704 A 7/1993 Erdman
5,388,967 A * 2/1995 Firnhaber et al. ..... 417/295
5,723,967 A * 3/1998 Hongo et al. ..... 318/254
5,801,500 A * 9/1998 Jensen et al. ..... 318/254
7,235,941 B2 * 6/2007 Park et al. ..... 318/439
2002/0117989 A1 8/2002 Kawabata et al.
2004/0239266 A1 * 12/2004 Lee et al. ..... 318/119
2005/0111987 A1 * 5/2005 Yoo et al. ..... 417/44.11
2006/0120898 A1 * 6/2006 Zeh ..... 417/416

FOREIGN PATENT DOCUMENTS

| | | | |
|---|---|---|---|
| AU | 710746 | B2 | 8/2002 |
| EP | 1 265 348 | A1 | 12/2002 |
| JP | 2001-251888 | | 9/2001 |
| JP | 2005-090466 | | 4/2005 |
| KR | 1996-077543 | | 12/1996 |
| KR | 1999-0039078 | | 6/1999 |

OTHER PUBLICATIONS

Korean Office Action for corresponding Application No. 10-2005-0097081 dated Oct. 16, 2006.
European Search Report for corresponding application 06122364.0-2315.

* cited by examiner

*Primary Examiner*—Bentsu Ro
(74) *Attorney, Agent, or Firm*—Staas & Halsey LLP

(57) ABSTRACT

A compressor having a sensorless motor and a driving method thereof. The compressor includes a sensorless motor having a rotation shaft connected to a rotator, a piston for performing a compression stroke and an intake stroke between a top dead center and a bottom dead center thereof, and a crank connecting the rotation shaft to the piston. The method includes forcibly aligning the rotator such that the rotator is positioned at a start position in the intake stroke of the piston, and accelerating rotation of the forcibly aligned rotator.

13 Claims, 5 Drawing Sheets

COMPRESSOR AND A DRIVING METHOD THEREOF

CROSS-REFERENCE TO RELATED APPLICATIONS

This application claims priority from Korean Patent Application No. 10-2005-0097081, filed on Oct. 14, 2005, in the Korean Intellectual Property Office, the disclosure of which is incorporated herein by reference.

BACKGROUND OF THE INVENTION

1. Field of the Invention

The present invention relates to a compressor and a driving method thereof. More particularly, to a compressor including a sensorless motor and a driving method of the compressor.

2. Description of the Related Art

A conventional brushless direct current (BLDC) motor, used in a compressor, is a motor driven through switching by an electronic circuit using transistors, particularly metal oxide silicon field effect transistors (MOSFETs), instead of a brush and a commutator, which are important parts of a direct current (DC) motor. This type of motor operates to distribute current, which is supplied from a DC power supply, to a three or four-phase winding of the motor. To this end, the position of a rotator is detected, and based on the detected position, a switching operation of the transistors is controlled to adjust the current supplied to the three-phase winding of the motor. Thus, the rotation and the speed of the motor are controlled.

In order to drive the BLDC motor without a sensor for sensing a rotation speed of the motor or a position of a rotator of the motor, the rotation speed of the motor or the position of the rotator must be indirectly detected from a phase current or a terminal voltage supplied to the BLDC motor. One conventional method to detect the position of the rotator includes the use of counter electromotive force-related information. However, since the counter electromotive force is proportional to a rotation speed of the rotator, it can not be used to detect the position of the rotator when the rotator stops or rotates at a low speed. Accordingly, when the BLDC motor is initially started, the rotator of the motor is aligned to a specified position by supplying current to a winding of the motor for a predetermined period of time. Then, the BLDC motor in a stop state is synchronically accelerated until the magnitude of the counter electromotive force reaches a sufficiently detectable value.

Although the rotator is forced to be aligned initially, when the current is applied to the winding of the motor without accurate information on the position of the rotator, overcurrent may be generated when the position of the rotator is not correct. Accordingly, a torque pulsation having a large width may be generated. Such overcurrent generation lowers the efficiency of the motor.

In addition, since the rotator is forced to be aligned without accurate information on the position of the rotator, when the motor is started in a condition where any pressure exists in the motor, a large amount of current must be supplied to the motor for a long time and a start failure rate increases.

SUMMARY OF THE INVENTION

Accordingly, it is an aspect of the present invention to provide a compressor and a driving method of the compressor starting without generation of overcurrent.

It is another aspect of the present invention to provide a compressor and a driving method of the compressor starting without difficulty when pressure exists in a motor of the compressor.

It is yet another aspect of the present invention to provide a driving method of a compressor, which is capable of reducing a starting current and reducing demagnetization of a rotator of the motor.

Additional aspects and/or advantages of the invention will be set forth in part in the description which follows and, in part, will be apparent from the description, or may be learned by practice of the invention.

The foregoing and/or other aspects of the present invention can be achieved by providing a driving method of a compressor including a sensorless motor including a rotation shaft connected with a rotator, a piston to perform a compression stroke and an intake stroke between a top dead center and a bottom dead center thereof, and a crank to connect the rotation shaft to the piston, the method including forcibly aligning the rotator such that the rotator is positioned at a start position in the intake stroke of the piston, and accelerating a rotation of the forcibly aligned rotator.

According to an aspect of the invention, a plurality of phase-magnetization modes exists between the top dead center and the bottom dead center, and the start position includes a phase-magnetization mode adjacent with the top dead center.

According to an aspect of the invention, the driving method further includes initially aligning the rotator before forcibly aligning the rotator such that the rotator is aligned at the bottom dead center.

According to an aspect of the invention, the forcibly aligning the rotator includes moving the rotator between the phase-magnetization modes toward the top dead center from the bottom dead center to prevent overcurrent and to align the rotator, accurately.

According to an aspect of the invention, a plurality of phase-magnetization modes exists between the top dead center and the bottom dead center, and a range between the phase-magnetization modes corresponds to approximately 10 to 20% of a range from the top dead center to the bottom dead center.

According to an aspect of the invention, the driving method further includes determining whether the rotator is aligned at the start position after forcibly aligning the rotator and before accelerating the rotation of the forcibly aligning the rotator.

According to an aspect of the invention, determining whether the rotator is aligned at the start position includes determining whether a difference between a predetermined instruction value and current feed-back from the sensorless motor is outside of a predetermined allowable range. The determination operation is not limited to the foregoing method, and any determination operation can be used to determine the position of the rotator.

According to an aspect of the invention, the driving method further includes determining whether the rotator is moved to a predetermined phase-magnetization mode after moving the rotator from the bottom dead center to the top dead center between the phase-magnetization modes.

Another aspect of the present invention is achieved by providing a driving method of a compressor having a sensorless motor and a piston connected via a connecting bar, the method including forcibly aligning a rotator of the sensorless motor to a start position in an intake stroke of the piston towards a top dead center thereof, and accelerating a rotation of the forcibly aligned rotator.

Another aspect of the present invention is achieved by providing a compressor including a sensorless motor having a rotator, a piston to perform a compression stroke and an intake stroke between a top dead center and a bottom dead center thereof, an inverter to supply current to the sensorless motor, and a controller to determine whether the rotator is aligned at a start position corresponding to the intake stroke of the piston and to output a control signal to the inverter.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
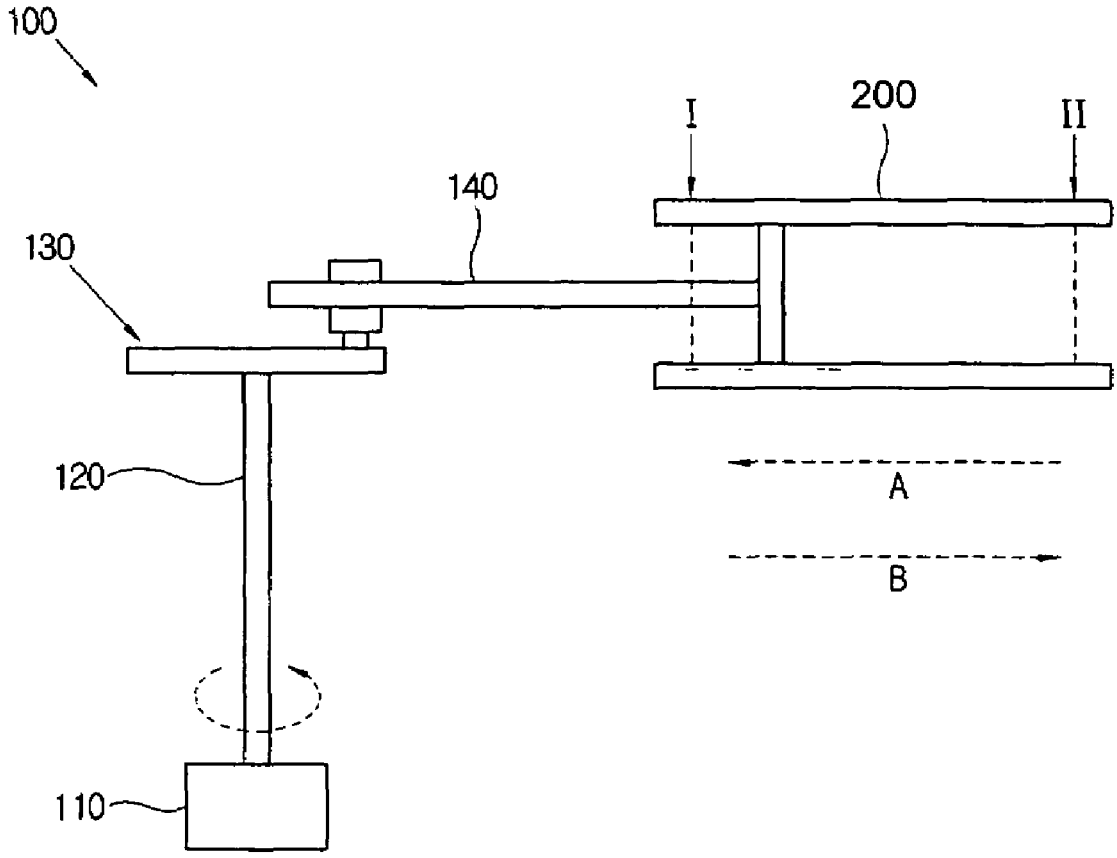
FIG. 1 is a schematic view illustrating a compressor according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
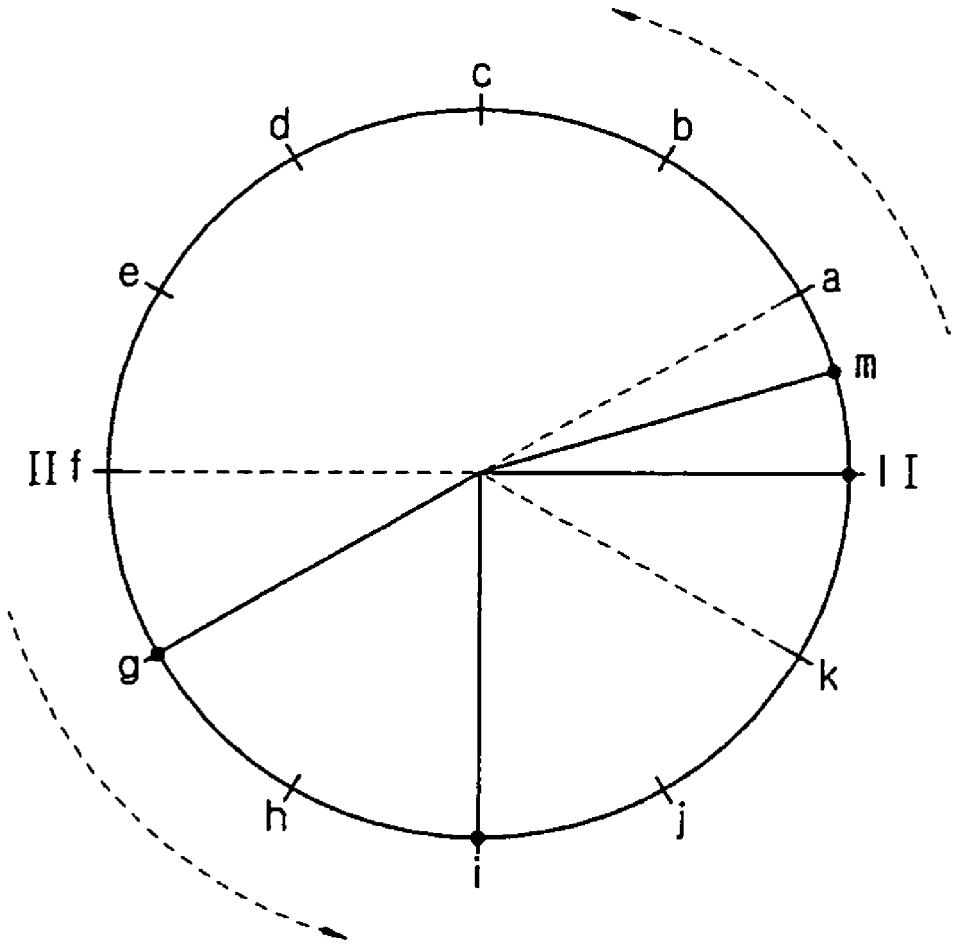
FIG. 2 is a diagram illustrating a movement of a rotator in order to explain a driving method of the compressor shown in FIG. 1.

FIG. 1 is a schematic view illustrating a compressor according to the first embodiment of the present invention, and FIG. 2 is a diagram illustrating a movement of a rotator in order to explain a driving method of the compressor.

As shown in FIG. 1, the compressor comprises a sensorless motor 100 and a piston 200 connected with the sensorless motor 100 via a connecting bar 140. The compressor further comprises an inverter to supply current of three phases to the sensorless motor 100 and a controller to control the overall operation of the sensorless motor 100 (see FIG. 3).

The sensorless motor 100 comprises a rotator 110 (for example, a rotor) to rotate with respect to a stator (not shown), a rotation shaft 120 connected with the rotator 110, and a crank 130 to connect the rotation shaft 120 to the piston 200.

The sensorless motor 100 according to this embodiment is a brushless DC motor. When a direct current is supplied to the sensorless motor 100 via a switching unit of the inverter, and the rotator 110 is rotated, a counter electromotive force is generated in three-phase windings of the sensorless motor 100. Thus, the controller detects a position of the rotator 110 based on information on the counter electromotive force of the three-phase windings and causes current to be applied to a phase-magnetization mode. The controller generates a pulse width modulation (PWM) control signal while the current is applied to the phase-magnetization mode. The PWM control signal is output to the inverter to adjust current to be supplied to the motor.

The switching unit of the inverter comprises a plurality of transistors to perform an on/off operation. Through the on/off operation of the transistors, the inverter supplies current to two of the three-phase windings of the sensorless motor 100 and controls the rotation speed of the sensorless motor 100 through the current applied to the windings of two phases. That is, the sensorless motor 100 according to this embodiment, which is a direct current-type motor, detects the position of the rotator 110 and is driven while controlling current to be supplied to the windings of two phases of the three-phase windings based on the detected position of the rotator 110.

The rotation shaft 120 is connected with the rotator 110 and the crank 130, which is in turn connected with the piston 200 via the connecting bar 140. When the rotator 110 is rotated, a rotary motion of the rotator 110 is translated into a reciprocating motion of the piston 200 by the crank 130 connected with the rotation shaft 120.

The piston 200 reciprocates between a top dead center (II) and a bottom dead center (I) and performs a compression stroke (A) and an intake stroke (B). The top dead center (II) is a point at which the piston 200, which arrives at the highest position, ends the compression stroke (A) and starts the intake stroke (B), and the bottom dead center (I) is a point at which the piston 200 ends the intake stroke (B) and starts the compression stroke (A). That is, the piston 200 performs the compression stroke (A) while moving from the bottom dead center (I) to the top dead center (II) and performs the intake stroke (B) while moving from the top dead center (II) to the bottom dead center (I). Fluids such as refrigerant are connected with the top dead center (II) of the piston 100. Compression and intake of the fluids are repeated through the motion of the piston 200.

FIG. 2 is a diagram illustrating the rotation of the rotator 110 corresponding to the compression stroke (A) and the intake stroke (B) of the piston 200. A pendulum in the figure is roughly shown to indicate a position of the rotator 110.

Current of two phases is supplied to the three-phase windings of the sensorless motor 100. There are six phase-magnetization modes in one stroke. That is, among a combination ($2^3$) of three-phase current, a combination of current supplies corresponding to six cases exists except two cases (i.e., where all of the three-phase currents are supplied and where none of the three-phase currents are supplied). In other words, each phase-magnetization mode can determine the position of the rotator 110 in a stroke, and the position of the rotator 110 can be controlled by adjusting the current for each phase-magnetization mode.

In FIG. 2, there are six phase-magnetization modes from 'a' to 'f' during the compression stroke (A) in which the rotator 110 is rotated from the bottom dead center (I) to the top dead center (II), and there are six phase-magnetization modes from 'g' to 'l' during the intake stroke (B) in which the rotator 110 is rotated from the top dead center (II) to the bottom dead center (I). When the compressor stops while being driven, the rotator 110 of the sensorless motor 100 stays in the vicinity of the bottom dead center (I) before being started, at which point the compression stroke (A) starts, that is, between a point 'a' and a point 'k', for example, at a point 'm' by inertia.

The driving method of the compressor according to this embodiment further comprises initially aligning the rotator 110 at the bottom dead center (I) before forcibly aligning the rotator 110 to a predetermined point. This operation provides a reference to control the current required to move the rotator 110 to a point at which the rotator 110 is forced to bealigned, or control for conversion of the phase-magnetization modes. That is, the rotator 110 located between the point 'a' and the point 'k' is aligned at a point 'l', which corresponds to the bottom dead center (I).

Conventionally, since the rotator 110 is forced to be aligned according to a predetermined pattern, and then, enters an acceleration operation without accurate information on the position of the rotator 110, there is a risk of start failure of the compressor depending on a degree of residual pressure or load applied to the sensorless motor 100. That is, there may occur a demagnetization phenomenon that overcurrent flows to reduce efficiency of the rotator 110. Particularly, since the overcurrent is not supplied when the rotator 110 is located in the compression stroke, the compressor may fail to start and noises are also produced due to the rotation of the motor.

In order to overcome such a problem and to start the compressor without difficulty, the rotator 110 is aligned at a start position in the intake stroke (B). By aligning the rotator 110 in the intake stroke (B) rather than the compression stroke (A), the sensorless motor 110 can be accelerated with less current. It is even effective to align the rotator 110 in the intake stroke (B), when there is residual pressure in the sensorless motor 100.

In an embodiment of the present invention, the piston 200 goes through the intake stroke (B) as many times as possible in order to generate a driving force at the maximum by inertia, when the piston 200 reaches the compression stroke (A). When the rotator 110 is aligned at the top dead center (II), since the rotator 110 may be moved to the intake stroke (B) by inertia, a start position is set at a point adjacent with the top dead center (II). In this embodiment, the start position is a position of 'g', which is the phase-magnetization mode closest to the top dead center (II) at which the intake stroke (B) is performed.

An operation of forcibly aligning the rotator 110 to the start position from the initial alignment operation, is performed through sequential phase-magnetization operations of moving the rotator 110 between phase-magnetization modes from the bottom dead center (I) toward the top dead center (I). In moving the rotator 110 at a time from the initial alignment position to the start position, it is not easy to control current, and moreover, the rotator 110 may not be correctly aligned at the start position. Accordingly, in this embodiment, the rotator 110 is moved to the start position sequentially through the sequential phase-magnetization operations. An angle of movement of the rotator 110 through each phase-magnetization operation corresponds to one-sixth of a range from the top dead center (II) to the bottom dead center (I), and accordingly, the rotator is moved by one-sixth of one stroke at every movement between the phase-magnetization modes.

In FIG. 2, when the rotator 110 is forcibly aligned to point 'g', acceleration of the rotation of the rotator 110 is performed. The rotation of the rotator 110 is accelerated up to a speed at which a counter electromotive force generated by the rotator 110 can be stably detected.

Thereafter, the counter electromotive force is detected, and then, the sensorless motor 100 is driven using information on the position of the rotator, which is obtained based on the detected counter electromotive force. That is, the starting operation of the compressor is ended and the compressor is fully driven.

Hereinafter, a driving method of a compressor according to another embodiment of the present invention will be described with reference to FIGS. 3-5.

Figure 3:
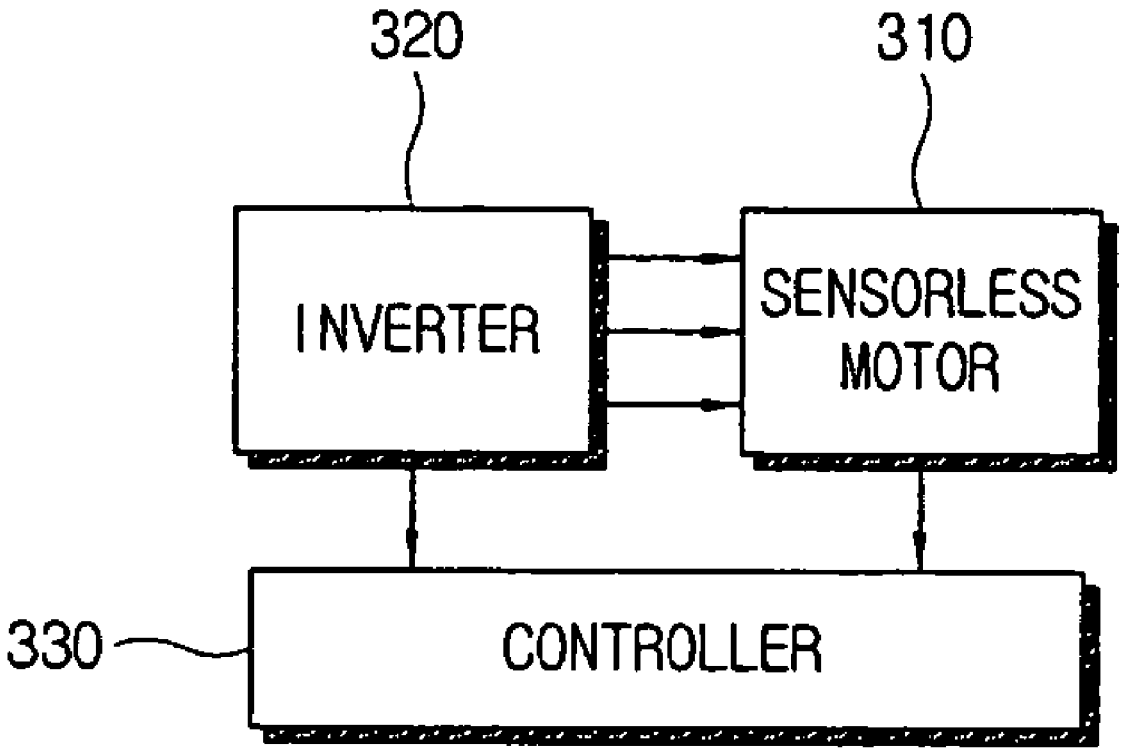
FIG. 3 is a control block diagram illustrating a compressor according to another embodiment of the present invention.
Figure 4:
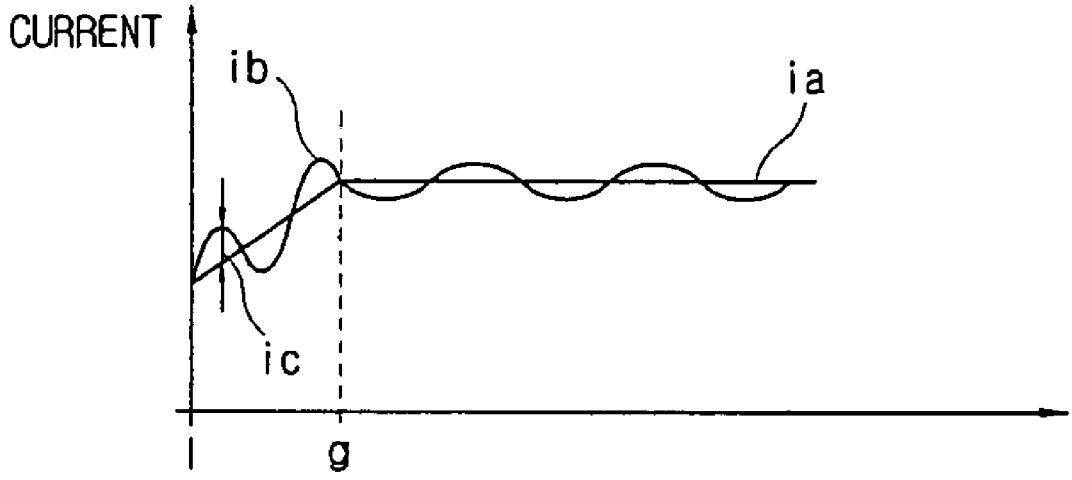
FIG. 4 is a graph illustrating current values depending on a position of a rotator of the compressor shown in FIG. 3, in order to explain a rotator position check operation.
Figure 5:
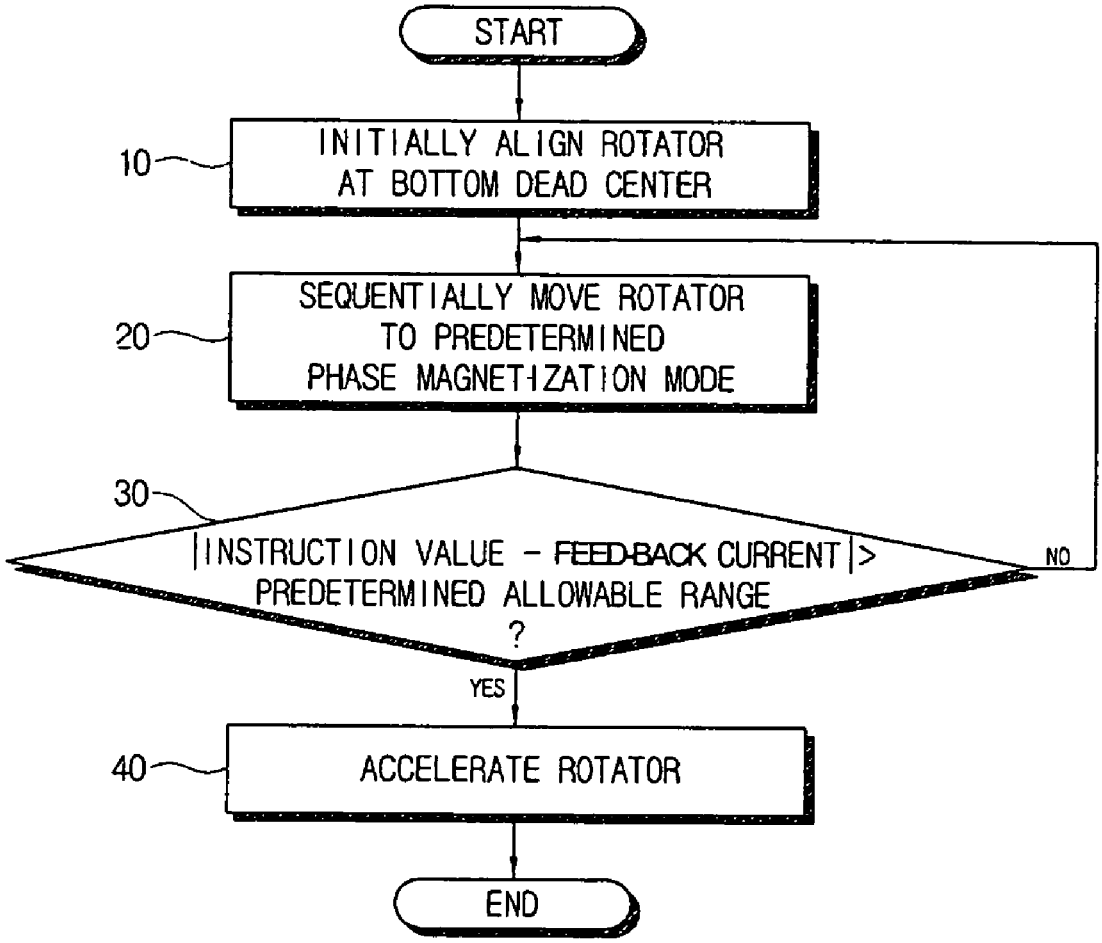
FIG. 5 is a control flow chart illustrating a driving method of the compressor shown in FIG. 3.

FIG. 3 is a control block diagram illustrating a compressor according to another embodiment of the present invention, FIG. 4 is a graph illustrating current values depending on the position of the rotator in order to explain a rotator position check operation of the compressor shown in FIG. 3, and FIG. 5 is a control flow chart illustrating the driving method of the compressor shown in FIG. 3.

As shown in FIG. 3, the compressor comprises a sensorless motor 310, an inverter 320 including a switching device to supply current of three phases to the sensorless motor 310, and a controller 330 to control the inverter 320.

The inverter 320 supplies current to the sensorless motor 310 by turning on/off a transistor, which is the switching device, according to a control signal output from the controller 330.

The controller 330 outputs the control signal to control the inverter 320, as described above with reference to the embodiment of the present invention as shown in FIG. 1. In addition, the controller 330 determines whether the rotator 110 is aligned at the start position (i.e., the point 'g') and either forcibly aligns the rotator or accelerates the rotator based upon the determination.

The controller 330 determines whether a difference between current feed-back from the sensorless motor 310 and a predetermined instruction value is outside of a predetermined allowable range, and outputs the control signal to the inverter 330 based on a result of the determination. The feed-back current is converted into a digital signal through an A/D converter and then is input to the controller 330.

A counter electromotive force generated when the rotator 110 is rotated acts as a disturbance component of the feed-back current. That is, the controller 310 compares the feed-back current containing the disturbance component with the instruction value and determines whether the difference therebetween falls within the predetermined allowable range.

Since the amount of current supplied to the sensorless motor gradually increases during 'I' to 'g' intervals within which the rotator is forcibly aligned, as shown in FIG. 4, the instruction value ($i_a$), which is a reference value, and the feed-back current ($i_b$) increase accordingly. Further, as shown in FIG. 4, disturbance produced due to the counter electromotive force is shown as a ripple of the feed-back current ($i_b$). The controller 330 obtains the difference ($i_c$) between the instruction value ($i_a$) and the feed-back current ($i_b$) and determines whether the difference ($i_c$) is outside of the predetermined allowable range.

Even through current is supplied to align the rotator 110 at the point 'g', when the rotator 110 is positioned at a point other than the point 'g', there occurs a difference ($i_c$) between the feed-back current ($i_b$) and the instruction value ($i_a$), and hence, the controller 330 can determine whether the rotator 110 is aligned at the start position depending on the difference ($i_c$).

As a result of the determination, when the difference ($i_c$) falls within the predetermined allowable range, the amount of rotation of the rotator 110 is not significant, and accordingly, the controller 330 determines that the rotator 110 is aligned at the start position.

In contrast, when the difference ($i_c$) is outside of the predetermined allowable range, the controller 330 determines that the amount of rotation of the rotator 110 is significant. Accordingly, since the rotator 110 is not yet aligned at the start position, current is again supplied to align the rotator 110 at the start position.

According to an alternative embodiment, the above-described operation may be performed for each of a plurality of phase-magnetization modes performed in the forced alignment operation. This operation may be performed according to the same mechanism as the above-described embodiment, but is not limited to any particular type of mechanism so long as only the position of the rotator 110 can be detected.

FIG. 5 is a flowchart illustrating the driving method of the compressor shown in FIG. 3.

In FIG. 5, at operation 10, the rotator 110 is initially aligned at the bottom dead center (I), which is a reference position.

From operation 10, the process moves to operation 20, where the initially aligned rotator 110 is sequentially moved to a plurality of phase-magnetization modes by current supplied from the inverter 320.

From operation 20, the process moves to operation 30, where the controller 330 determines whether the difference ($i_c$) between the current feed-back from the sensorless motor 310 and the instruction value falls within the predetermined allowable range.

As a result of the determination at operation 30, the process moves to operation 40, where when the difference ($i_c$) falls within the allowable range, the controller 330 determines that the rotator 110 is aligned at the start position and controls the rotator 110 to be accelerated. On the contrary, when the difference ($i_c$) is outside of the allowable range, the phase-magnetization modes are repeated.

Even though the rotator 110 is aligned at the start position, when the difference ($i_c$) is outside of the allowable range, the controller 330 controls current to be applied for a phase-magnetization mode corresponding to the start position.

As apparent from the above description, the present invention provides a driving method of a compressor starting without generation of overcurrent.

In addition, embodiments of the present invention provide a driving method of a compressor starting without difficulty even when any pressure exists in a motor.

Furthermore, embodiments of the present invention provide a driving method of a compressor, which is capable of reducing a starting current and reducing demagnetization of a rotator of a motor.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A driving method of a compressor comprising a sensorless motor including a rotation shaft connected with a rotator, a piston to perform a compression stroke and an intake stroke between a top dead center and a bottom dead center thereof, and a crank to connect the rotation shaft to the piston, the method comprising:

forcibly aligning the rotator such that the rotator is positioned at a start position in the intake stroke of the piston;

determining whether the rotator is aligned at the start position comprising determining whether a difference between a predetermined instruction value and current feedback from the sensorless motor is outside of a predetermined allowable range; and accelerating a rotation of the forcibly aligned rotator.

2. The driving method according to claim 1, wherein a plurality of phase-magnetization modes exists between the top dead center and the bottom dead center, and wherein the start position includes a phase-magnetization mode adjacent to the top dead center.

3. The driving method according to claim 2, wherein a range between the phase-magnetization modes corresponds to approximately 10 to 20% of a range from the top dead center to the bottom dead center.

4. The driving method according to claim 1, further comprising:

initially aligning the rotator before the forcibly aligning the rotator such that the rotator is aligned at the bottom dead center.

5. The driving method according to claim 4, wherein a plurality of phase-magnetization modes exists between the top dead center and the bottom dead center, and wherein the forcibly aligning the rotator comprises moving the rotator between the phase-magnetization modes toward the top dead center from the bottom dead center.

6. The driving method according to claim 5, wherein a range between the phase-magnetization modes corresponds to approximately 10 to 20% of a range from the top dead-center to the bottom dead center.

7. The driving method according to claim 5, further comprising:

determining whether the rotator is moved to a predetermined phase-magnetization mode after moving the rotator between the phase-magnetization modes toward the top dead center from the bottom dead center.

8. The driving method according to claim 7, wherein the determining whether the rotator is moved to a predetermined phase-magnetization mode comprises:

determining whether a difference between a predetermined instruction value and current feed-back from the sensorless motor is outside of a predetermined allowable range.

9. A compressor comprising:

a sensorless motor comprising a rotator;

a piston to perform a compression stroke and an intake stroke between a top dead center and a bottom dead center thereof;

an inverter to supply current to the sensorless motor; and a controller to determine whether the rotator is aligned at a start position corresponding to the intake stroke of the piston comprising determining whether a difference between current feedback from the sensorless motor and a predetermined instruction value falls within a predetermined allowable range, and to output a control signal to the inverter based upon a result of the determination.

10. The compressor according to claim 9, wherein when it is determined that the difference is outside of the predetermined allowable range, the controller determines that the rotator is not forcibly aligned to the start position and continues to supply current to forcibly align the rotator, and when it is determined that the difference falls within the predetermined allowable range, the controller determines that the rotator has been forcibly aligned to the start position.

11. The compressor according to claim 9, wherein the feed-back current is converted into a digital signal and then input to the controller.

12. The compressor according to claim 11, wherein:

a counter electromotive force which is generated when the rotator is rotated, the counter electromotive force being a disturbance of the feed-back current, and the controller compares the feed-back current including the disturbance with the predetermined instruction value and determines whether the difference falls within the predetermined allowable range.

13. The compressor according to claim 12, wherein a current supplied to the sensorless motor gradually increases when the rotator is being forcibly aligned such that the predetermined instruction value and the feed-back current increase.

* * * * *

UNITED STATES PATENT AND TRADEMARK OFFICE

CERTIFICATE OF CORRECTION

PATENT NO. : 7,477,032 B2
APPLICATION NO. : 11/520736
DATED : January 13, 2009
INVENTOR(S) : Hyen-young Choi et al.

It is certified that error appears in the above-identified patent and that said Letters Patent is hereby corrected as shown below:

Column 8, Lines 12-13, change “deadcenter” to --dead center--.

Signed and Sealed this

Thirty-first Day of March, 2009

JOHN DOLL
*Acting Director of the United States Patent and Trademark Office*